United States Patent [19]

Markowitz

[11] Patent Number: 4,619,120

[45] Date of Patent: Oct. 28, 1986

[54] DOUBLE LAYER FABRIC MATERIAL AND METHOD FOR MANUFACTURING SAME

[75] Inventor: Harry Markowitz, Great Neck, N.Y.

[73] Assignee: Bruedwill, Inc., New York, N.Y.

[21] Appl. No.: 626,397

[22] Filed: Jun. 29, 1984

[51] Int. Cl.[4] ..... C03B 15/14

[52] U.S. Cl. ..... 66/192; 66/193; 66/202; 428/253; 428/284

[58] Field of Search ..... 418/102, 253, 284; 66/190, 192, 193; 156/148

[56] References Cited

U.S. PATENT DOCUMENTS 4,026,129 5/1977 Sternlieb ..... 66/192

4,425,398 1/1984 Berczi ..... 428/253

4,472,086 9/1984 Leach ..... 428/253

*Primary Examiner*—James J. Bell

*Attorney, Agent, or Firm*—Kenyon & Kenyon

[57] ABSTRACT

A double layer fabric manufactured by means of a weft insertion knitting machine comprises a support web provided on a front face or surface with an at least partially rectangular or rectilinear printed design. An overlying fabric web is knitted to the front surface of the support web, the overlying web having a knitted structure with the appearance of a woven fabric having weft and warp yarns juxtaposed to respective lines in the printed design on the front surface of the support web so as to form an enhanced visual pattern on the material.

17 Claims, 5 Drawing Figures

DOUBLE LAYER FABRIC MATERIAL AND METHOD FOR MANUFACTURING SAME

BACKGROUND OF THE INVENTION

This invention relates to a double layer fabric and to a method for manufacturing the same.

A Malimo fabric consists essentially of knitted warp fibers, in between the knitted stitches of which further fibers are inserted. These auxiliary fibers are clamped and held in place by the knitted structure of the warp fibers and may traverse the width of the fabric in the manner of weft yarns in a woven web. It is a characteristic of the Malimo machine that such weft type yarns do not follow straight paths but rather follow undulating or oscillating paths. Rectilinear or straight weft type yarns in a knitted material of the Malimo type may be achieved, however, by a weft insertion machine.

One kind of Malimo fabric consists essentially of two layers or webs. A first fabric web is preformed and frequently is a nonwoven or bonded material. This nonwoven web is fed to a Malimo machine wherein the second web is simultaneously knitted and attached to the first web. During the knitting process, knitting needles pierce the preformed web, whereby the knitted loops or stitches of the second web are threadingly connected to the fibers of the first web.

Malimo fabrics are generally used in the field of home furnishings, for example, in window shades and draperies and as upholstery. In particular, the above described double layer fabric may serve as self-lined drapery.

The preformed web portion of a double layer Malimo material lends opacity to the "weave" of the knitted web and further increases the insulating properties of the Malimo material. The preformed web is invariably of a substantially uniform hue and is frequently of a white or off-white color.

An object of the present invention is to provide an improved double layer fabric of the above-described type.

Another object of the present invention is to provide such a fabric material with heightened aesthetic qualities.

Yet another object of the present invention is to provide such an improved fabric material which is especially easy and inexpensive to produce, in view of the heightened aesthetic qualities of the material.

Another, more particular, object of the present invention is to provide such a fabric in which the amount of yarn used is reduced.

A further object of the present invention is to provide a method for manufacturing such an improved fabric material.

SUMMARY OF THE INVENTION

A double layer fabric in accordance with the present invention comprises a first web bearing a printed design on a front side and a knitted second web having a multiplicity of knitted stitches penetrating and threadingly engaging the first web, whereby the knitted web is attached to the first web. The second web has a knitted structure appearing to comprise a coarsely woven web having a set of spaced warp yarns and a set of spaced weft yarns with yarn sizes, yarn colors and respective predetermined substantially uniform interyarn distances coordinated with the printed design on the first web to form a visually detectable pattern which is different in appearance from the printed design and from the coarsely "woven" knitted web.

The printed design on the first web incorporates one or more groups of parallel printed elongate shapes such as lines or line segments, at least one of the sets of warp and weft yarns extending parallel to one of the groups of parallel line segments on the first web. The printed design is advantageously an at least partially rectangular design composed of two mutually orthogonal groups of parallel printed elongate shapes such as lines, one of the sets of yarns extending parallel to one of the groups of lines and the other of the sets of yarns extending parallel to the other of the groups of lines.

In accordance with another particular feature of the present invention, at least some yarns of one set are contiguous or juxtaposed along at least a portion their lengths with respective printed lines or line segments in the design on the first web. Some of the yarns of the knitted web preferably overlie respective printed lines on the preformed web, while other weft or warp yarns are disposed between adjacent parallel elongate shapes of the printed design.

A double layer fabric in accordance with the present invention is manufactured by preforming the first web, preferably by a fiber bonding process, printing the design on a front side of the first web and knitting the second web to the front side of the first web in such a way that the second web appears to comprise a coarsely woven web having a set of warp yarns and a set of weft yarns having interyarn distances, yarn sizes and yarn colors coordinated with the printed design to form a visually detectable pattern.

A double layer fabric in accordance with the present invention is formed on a weft insertion knitting machine which enables the knitted structure of the second web to assume a woven aspect with linearly extending warp yarns and weft yarns. These straight yarns, in contrast to the undulating or oscillating yarns produced by a Malimo knitting machine, facilitate the production of a predetermined visually detectable pattern in the finished fabric, e.g., enable the alignment of the warp and/or weft yarns with the lines of the printed design in the first web.

A double layer fabric pursuant to the present invention may have a relatively complex pattern or design on the front side of the fabric. Moreover, such a complex pattern may be produced at a reduction in cost at least in part owing to the decrease in the amount of yarn needed to form the pattern.

DETAILED DESCRIPTION OF THE INVENTION

Figure 1:
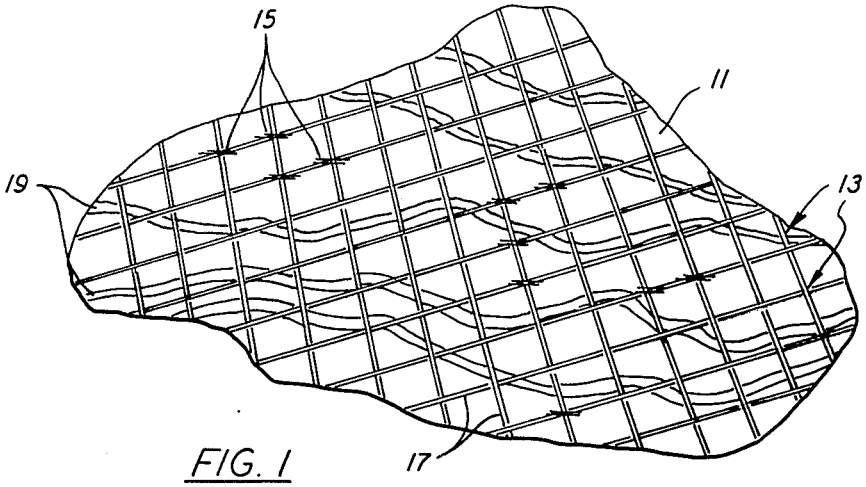
FIG. 1 is a schematic partial front elevational view of a conventional two layer or double ply fabric material produced by a Malimo machine.

As illustrated schematically in FIG. 1, a double layer fabric manufactured by means of a Malimo machine comprises a first web 11 which serves as a backing and support for a knitted second web 13. Web 11 may be made of paper, synthetic resin or cloth and may be woven, knitted or nonwoven, e.g., produced by means of a bonding process. The second web is formed by a knitting process in which the stitching needles of a Malimo machine recurrently pierce or penetrate support web 11. At least some of the knitted stitches of web 13 thereby threadingly engage support web or fabric 11, as schematically indicated in FIG. 1 at 15.

Fabric web 13 of a double layer fabric produced by a Malimo machine has a set of fibers 17 in a net-like arrangement and a set of weft fibers 19, the weft fibers following a generally undulating or oscillating path from one side of the double layer fabric to the other side.

Web 11 is, in accordance with customary practice in the trade, a generally uniform sheet of material having a uniform hue or color.

In accordance with the present invention, a fabric support web 21 (see FIGS. 2 and 3) of preferably nonwoven material is printed on a front face or side with a multiplicity of generally parallel elongate shapes such as lines or line segments 23. Lines 23 may be of one or more colors and may have a width 25 and an interline spacing 27, one or both of which may be variable across the length of the web 21.

Web 21 is fed to a weft insertion machine effective to produce a Malimo type fabric in which the knitted layer has the appearance of a woven web having parallel spaced warp and weft yarns.

Figure 2:
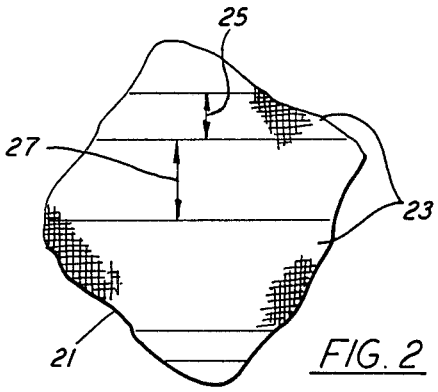
FIG. 2 is a schematic partial front elevational view of a backing material for a double layer fabric in accordance with the present invention.
Figure 3:
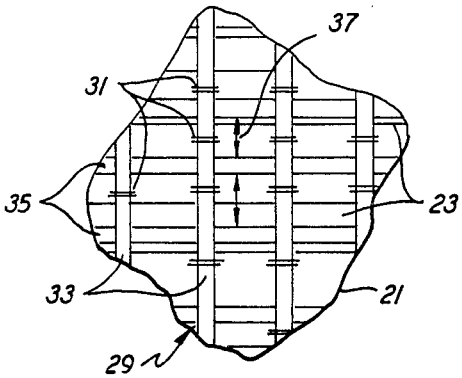
FIG. 3 is a schematic partial front elevational view of a double layer fabric, including the fabric web illustrated in FIG. 2, in accordance with the present invention.
Figure 5:
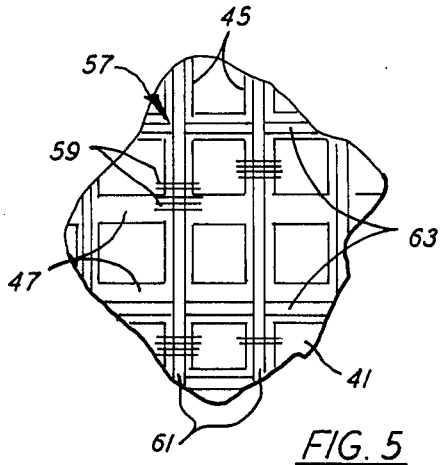
FIG. 5 is a view similar to FIG. 3, showing a double layer fabric incorporating the fabric layer of FIG. 4, in accordance with the present invention.

As schematically illustrated in FIG. 3, a double layer fabric in accordance with the present invention includes a knitted fabric web 29 threadedly secured to support web 21 at 31. Fabric web 29 has a knitted structure giving the appearance of a woven web having a multiplicity of warp yarns 33 and a multiplicity of weft yarns 35. Pairs of adjacent weft yarns 35 have a substantially uniform interyarn spacing 37 matched to widths 25 and interyarn spacing 27 of printed lines 23 (see FIG. 2) so that every other weft yarn 31 overlies a respective printed line segment or elongate shape 23 of support web 21 and so that, concomitantly, the other weft yarns 35 are disposed in the spaces between consecutive or adjacent line segments 23.

The width, the color and the spacing of weft yarns 35 may be varied in accordance with width 25, spacing 27 and the color of printed line segments or strips 23 in order to modify the appearance of the resultant pattern. In any case, the visually detectable pattern produced on the front face or side of a double layer fabric manufactured in accordance with present invention will be at least to some extent controllably different from the design formed by lines or strips 23 on the front face of support web 21 and different from the design formed by weft and warp yarns 33 and 35 in and of themselves.

Figure 4:
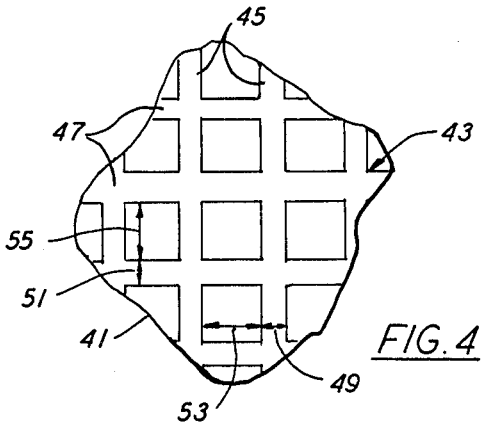
FIG. 4 is a view similar to FIG. 2, showing a portion of a backing layer of a double layer fabric in accordance with the present invention.

As illustrated in FIG. 4, a backing or support web 41 for a doublelayer fabric in accordance with the present invention may comprise a nonwoven material provided on a front face or surface with a rectangular design or grid 43 consisting of a multiplicity of substantially parallel first line segments 45 and a multiplicity of second line segments 47 orthogonal or perpendicular thereto. Line segments or strips 45 and 47 have respective substantially uniform widths 49 and 51 and pairs of adjacent strips 45 and 47 have respective substantially uniform interline or interstrip spacings 53 and 55. However, widths 49 and 51 and spacings 53 and 55 may vary from strip to strip and from strip pair to strip pair, respectively.

As heretofore described with respect to FIGS. 2 and 3, support web 41 is preferably fed to a weft insertion machine wherein the support web is knittingly attached to a knitted web 57 at 59. Knitted web 57 has a structure giving the appearance of a woven web having a set of warp yarns 61 and a set of weft yarns 63 perpendicular thereto. Warp yarns 61 have an interyarn spacing approximately equal to spacing 53 between strips 45 (see FIG. 4), while weft yarns 63 have an interyarn spacing equal to approximately twice the spacing 55 between adjacent printed strips or lines 47. The Malimo-type knitting machine is operated so that warp yarns 61 and weft yarns 63 are juxtaposed to respective line segments 45 and 47 of support web 41. The juxtaposition of the warp and weft yarns of knitted web 57 with the printed strips or lines of grid 43 enhances the appearance of a double layer fabric in accordance with the present invention by providing the illusion that the knitted fabric web 57 consists of more or heavier yarns than it actually does.

Owing in part to the use of a weft insertion machine capable of producing knitted webs with apparently parallel and rectilinear warp and weft yarns, a double layer fabric in accordance with the present invention may be provided with a relatively complex visual design at reduced manufacturing cost. It is clear that the design printed on the support web or fabric need not be rectangular or rectilinear, as long as the knitted warp and weft yarns of the knitted fabric web are appropriately juxtaposed to the various elements of the printed design to produce a visually recognizable composite pattern or design.

Although the invention has been described in terms of specific embodiments and applications, persons skilled in the art, in light of this teaching, can generate additional embodiments without exceeding the scope or departing from the spirit of the claimed invention. Accordingly, it is to be understood that the drawings and descriptions in this disclosure are proffered to facilitate comprehension of the invention and should not be construed to limit the scope thereof.

What is claimed is:

1. A double layer fabric material comprising:

a first web bearing on one side a printed design having at least one group of parallel printed elongate shapes; and a knitted second web substantially on said one side of said first web, said second web having a multiplicity of knitted stitches penetrating and threadingly engaging said first web, whereby said second web is attached to said first web, said second web having a substantially orthogonal yarn structure with a first set of substantially parallel spaced yarns and a second set of substantially parallel spaced yarns, the yarns of said first set extending substantially perpendicularly to the yarns of said second set, said yarns having yarn sizes, yarn colors and interyarn distances coordinated with said printed design to form a visually detectable pattern different from said printed design and different from said substantially orthogonal yarn structure, one of said sets of yarns extending substantially parallel to said elongate shapes.

2. The double layer fabric material defined in claim 1 wherein at least some of the yarns of said one of said sets are juxtaposed on said one side of said first web to respective ones of said elongate shapes.

3. The double layer fabric material defined in claim 2 wherein said first web is a nonwoven fabric web.

4. The double layer fabric material defined in claim 1 wherein said printed design is at least partially a rectangular grid having two mutually orhogonal groups of parallel printed elongate shapes, one of said sets extending parallel to one of said groups and the other of said sets extending parallel to the other of said groups.

5. The double layer fabric material defined in claim 4 wherein said first web is a nonwoven fabric web.

6. The double layer fabric material defined in claim 1 wherein said first set of substantially parallel spaced yarns comprises a multiplicity of yarns knitted to form parallel chains of interlocking loops extending in a first direction, said second set of substantially parallel spaced yarns comprising a multiplicity of substantially straight yarns extending in a second direction perpendicular to said first direction.

7. A double layer fabric material comprising:

a first web bearing on one side a printed design having at least one group of parallel printed elongate shapes; and a knitted second web on said one side of said first web, said second web having a multiplicity of knitted stitches penetrating and threadingly engaging said first web, whereby said second web is attached to said first web, said second web having a substantially orthogonal yarn structure with a first set of substantially parallel spaced yarns extending in a first direction and a second set of yarns knitted to form a multiplicity of parallel chains of interlocking loops, said chains of interlocking loops extending in a second direction substantially perpendicular to said first direction, said yarns having yarn sizes, yarn colors and interyarn distances coordinated with said printed design to form a visually detectable pattern different from said printed design and different from said substantially orthogonal yarn structure, one of said directions extending substantially parallel to said elongate shapes.

8. A double layer fabric material comprising:

a first web bearing on one side a printed design; and a knitted second web substantially on said one side of said first web, said second web having a multiplicity of knitted stitches penetrating and threadingly engaging said first web, whereby said second web is attached to said first web, said second web having a substantially orthogonal yarn structure with a first set of substantially parallel spaced yarns and a second set of substantially parallel spaced yarns, the yarns of said first set extending substantially perpendicularly to the yarns of said second set, said yarns having yarn sizes, yarn colors and interyarn distance coordinated with said printed design to form a visually detectable pattern different from said printed design and different from said substantially orthogonal structure.

9. The double layer fabric material defined in claim 8 wherein said first set of substantially parallel spaced yarns comprises a multiplicity of yarns knitted to form parallel chains of interlocking loops extending in a first direction, said second set of substantially parallel spaced yarns comprising a multiplicity of substantially straight yarns extending in a second direction perpendicular to said first direction.

10. The double layer fabric material defined in claim 8 wherein said first web is a nonwoven fabric web.

11. A method of manufacturing a double layer fabric material, comprising the steps of:

providing a first web having on a front side a printed design with at least one group of parallel printed elongate shapes;

knitting a second web to the front side of said first web by means of a weft insertion machine so that said second web has a substantially orthogonal yarn structure with a first set of substantially parallel spaced yarns and a second set of substantially parallel spaced yarns, the yarns of said first set extending substantially perpendicularly to the yarns of said second set;

coordinating yarn sizes, yarn colors and interyarn distances with said design to form a visually detectable pattern different from said design and different from said substantially orthogonal yarn structure; and controlling stitching operations to form one of said sets to have yarns extending parallel to said elongate shapes.

12. The method defined in claim 11 wherein said step of fabricating includes the bonding of fibers to form a nonwoven web.

13. The method defined in claim 11 wherein said first set of substantially parallel spaced yarns comprises a multiplicity of yarns knitted to form parallel chains of interlocking loops extending in a first direction, said second set of substantially parallel spaced yarns comprising a multiplicity of substantially straight yarns extending in a second direction perpendicular to said first direction.

14. A method of manufacturing a double layer fabric material, comprising the steps of:

providing a first web having on a front side a printed design with at least one group of parallel printed elongate shapes;

knitting a second web to the front side of said first web by means of a weft insertion machine so that said second web has a substantially orthogonal yarn structure with a first set of substantially parallel spaced yarns extending in a first direction and a second set of yarns knitted to form a multiplicity of parallel chains of interlocking loops, said chains of interlocking loops extending in a second direction substantially perpendicular to said first direction;

coordinating yarn sizes, yarn colors and interyarn distances with said design to form a visually detectable pattern different from said design and different from said substantially orthogonal yarn structure; and controlling stitching operations to align one of said directions parallel to said elongate shapes.

15. A method of manufacturing a double layer fabric material, comprising the steps of:

providing a first web having on a front side a printed design;

knitting a second web to the front side of said first web by means of a weft insertion machine so that said second web has a substantially orthogonal yarn structure with a first set of substantially parallel spaced yarns and a second set of substantially parallel spaced yarns, the yarns of said first set extending substantially perpendicularly to the yarns of said second set; and coordinating yarn sizes, yarn colors and interyarn distances with said design to form a visually detectable pattern different from said design and different from said substantially orthogonal yarn structure.

16. The method defined in claim 15 wherein said first set of substantially parallel spaced yarns comprises a multiplicity of yarns knitted to form parallel chains of interlocking loops extending in a first direction, said second set of substantially parallel spaced yarns comprising a multiplicity of substantially straight yarns extending in a second direction perpendicular to said first direction.

17. The method defined in claim 15 wherein said first web is a nonwoven fabric web.

* * * * *